US005739424A

United States Patent [19]

Beavers

[11] Patent Number: 5,739,424

[45] Date of Patent: Apr. 14, 1998

[54] GALVANIC CORROSION INHIBITING COUPLING INTERPOSED BETWEEN TWO DISSIMILAR PIPES

[75] Inventor: John A. Beavers, Columbus, Ohio

[73] Assignee: CC Technologies Laboratories, Inc., Dublin, Ohio

[21] Appl. No.: 760,042

[22] Filed: Dec. 4, 1996

[51] Int. Cl.[6] ..... C23F 13/00

[52] U.S. Cl. ..... 73/86; 204/196

[58] Field of Search ..... 73/86; 204/196; 307/95; 205/724, 725, 727, 730–733, 738, 740

[56] References Cited

U.S. PATENT DOCUMENTS

| | | | |
|---|---|---|---|
| 2,076,422 | 4/1937 | Zimmerer et al. | 204/196 |
| 2,076,466 | 4/1937 | Koerber | 204/196 |
| 3,477,930 | 11/1969 | Crites | 204/196 |
| 3,977,956 | 8/1976 | Bagnulo | 204/196 |

FOREIGN PATENT DOCUMENTS

| | | | |
|---|---|---|---|
| 4-04313379 | 11/1992 | Japan | 204/196 |
| 1008280 | 3/1983 | U.S.S.R. | 204/196 |

*Primary Examiner*—Robert Raevis

*Attorney, Agent, or Firm*—Frank H. Foster; Kremblas, Foster, Millard & Pollick

[57] ABSTRACT

The device is an electrically insulating tube which is rigidly mounted between the ends of two dissimilar metal pipes. Longitudinally spaced, annular electrodes are mounted in grooves formed in the cylindrical interior wall. The electrodes are electrically connected to the fluid within the chamber. The chamber is defined by the interior walls of the pipes and the tube. A current source is electrically connected to the electrodes, for generating a current between the electrodes, creating an ohmic potential drop in the fluid that minimizes the potential shift of the pipes from that naturally existing in the absence of the dissimilar metal couple. Sensors sense the naturally existing potential of the pipes for varying the current between the electrodes.

18 Claims, 9 Drawing Sheets

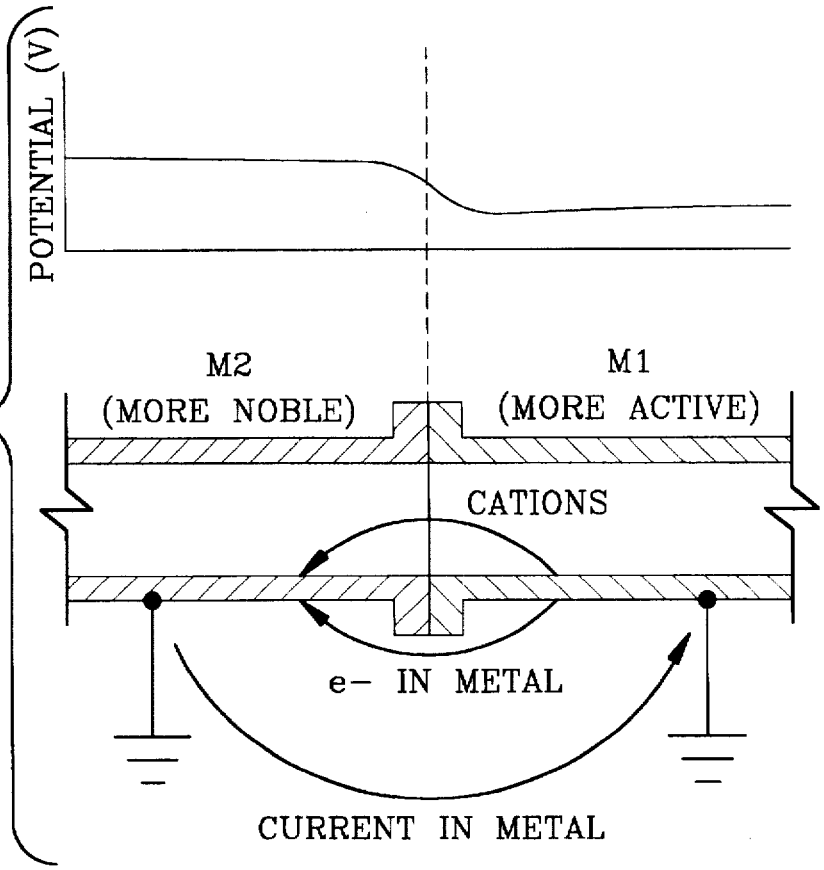
FIG−1
PRIOR ART
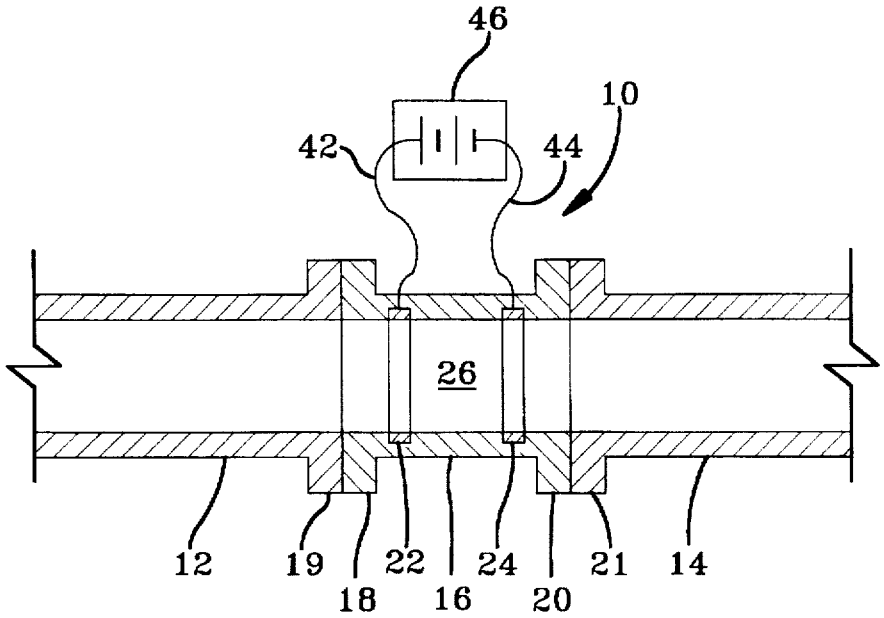
FIG−2

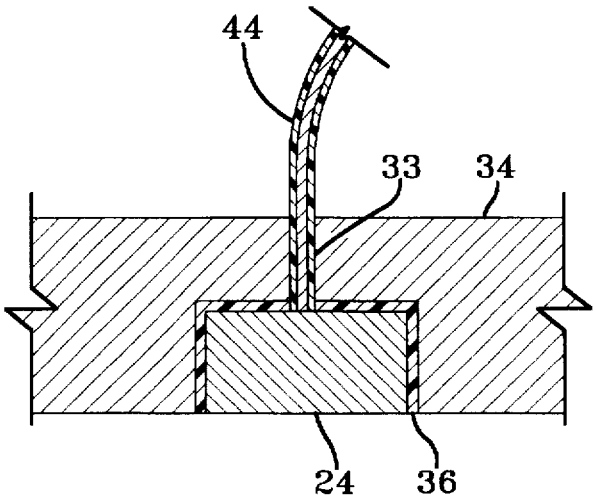
FIG-3
FIG-4
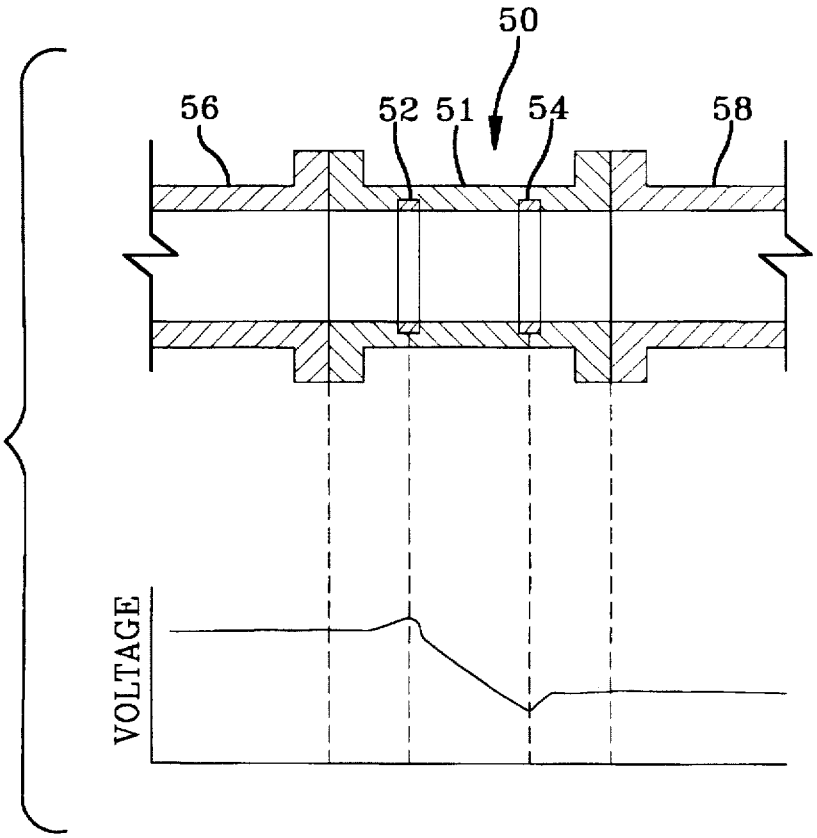

POTENTIAL AS A FUNCTION OF A DISTANCE WITHIN COPPER – GALVANIZED STEEL PIPING COUPLE WITH METALS ELECTRICALLY UNCOUPLED AND ISOLATION DEVICE TURNED OFF.

POTENTIAL AS A FUNCTION OF A DISTANCE WITHIN COPPER - GALVANIZED STEEL PIPING COUPLE WITH METALS ELECTRICALLY COUPLED AND ISOLATION DEVICE TURNED OFF.

GALVANIC CURRENT BETWEEN COPPER AND GALVANIZED STEEL IN PIPING COUPLE AS A FUNCTION OF TIME WITH ISOLATION DEVICE TURNED OFF.

GALVANIC CURRENT BETWEEN COPPER AND GALVANIZED STEEL IN PIPING COUPLE AS A FUNCTION OF APPLIED CURRENT BETWEEN ELECTRODES IN ISOLATION DEVICE.

POTENTIAL AS A FUNCTION OF A DISTANCE WITHIN COPPER – GALVANIZED STEEL PIPING COUPLE WITH METALS ELECTRICALLY COUPLED AND CURRENT IN ISOLATION DEVICE SET AT 30 mA.

GALVANIC CORROSION INHIBITING COUPLING INTERPOSED BETWEEN TWO DISSIMILAR PIPES

TECHNICAL FIELD

The invention relates generally to the field of corrosion inhibiting devices for inhibiting galvanic corrosion between two dissimilar metals. The invention relates more specifically to a corrosion inhibiting coupling interposed between two dissimilar electrolyte conveying pipes.

BACKGROUND ART

On large, ocean bound ships, for example military ships, sea water is used in the vessel for various purposes, such as cooling. This water, which is an electrolyte, is conveyed through pipes within the ship. In a typical ship, there can be hundreds of feet of pipe, all of which are grounded in order to reduce static charge build-up.

Where two pipes of dissimilar metals $m_1$ and $m_2$ are physically coupled, as shown in FIG. 1, there is an electrical potential between the metals $m_1$ and $m_2$ which causes galvanic corrosion of one of the metals. Because the two metals have a potential difference (reflected by the potential gradient in the electrolyte illustrated in the graph of FIG. 1), and are electrically connected, positive ions break away from the less corrosion resistant metal and pass through the electrolyte to the more corrosion resistant metal. The electrons which are released from the metal at the surface of the less corrosion resistant material travel through the metal, generating a small electrical current.

It is not practical to attempt to insulate the dissimilar metals from one another because every pipe must be grounded to reduce static charge build-up. If insulating material were interposed between pipe segments, the ground would still electrically connect all the insulated segments of pipe. Alternatively, it may be considered desirable to increase the resistance to the flow of ions (caused by the potential difference) by inserting a long, inert pipe between the two dissimilar metal pipes. However, the length necessary to make an effective "resistor" has been found to be so great as to make this solution unfeasible. Additionally, conventional cathodic protection in which current flows through the electrolyte to the metal being protected, is not satisfactory in this environment due to hydrogen embrittlement it causes.

Therefore, the need exists for a corrosion inhibiting device which effectively inhibits galvanic corrosion, but which avoids the hydrogen embrittlement associated with creating a current flow to the metal being protected.

BRIEF DISCLOSURE OF INVENTION

The invention is a corrosion inhibiting apparatus mounted at the junction of two chemically different, elongated metal bodies, such as pipes. The elongated metal bodies define an interior fluid chamber which contains an electrolyte. The apparatus comprises a support member mounted between the metal bodies and in a gap formed between the metal bodies, spacing the metal bodies from each other. First and second longitudinally spaced electrodes are mounted to the support member in communication with the electrolyte. A current source is electrically connected to the electrodes.

The invention contemplates the metal bodies being pipes made of dissimilar metals and the support member being a hollow, electrically insulating pipe aligned with the dissimilar metal pipes. The invention further contemplates the electrodes comprising first and second annular metal rings mounted in longitudinally spaced circumferential grooves formed on the interior wall of the support member. The current source produces a current between the electrodes which creates an ohmic potential drop in the electrolyte and inhibits galvanic corrosion.

BRIEF DESCRIPTION OF DRAWINGS

FIG. 1 is a side view in section illustrating a conventional pipe junction and a graph of voltage along the pipes;

FIG. 2 is a side view in section illustrating an embodiment of the present invention in its operable position;

FIG. 3 is a side view in section illustrating detail of the electrode mounted in the support member;

FIG. 4 is a side view in section illustrating an embodiment of the invention and a graph of voltage along the pipes;

FIG. 12 is a graph of the potential versus the distance along the experimental apparatus with the dissimilar metals coupled and the device turned on.

Figure 5:
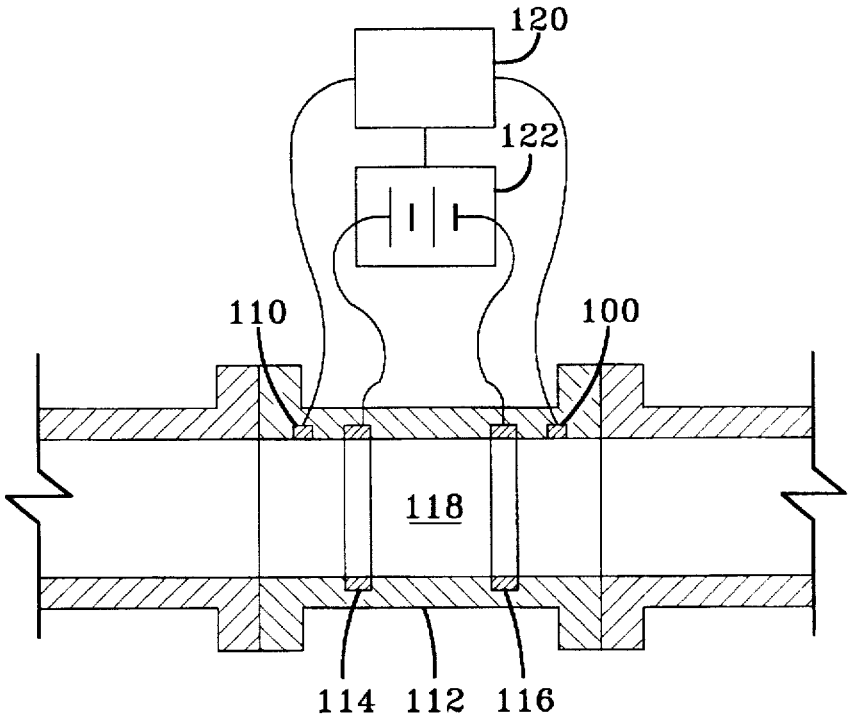
FIG. 5 is a side view in section illustrating a preferred embodiment of the present invention.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected or terms similar thereto are used. They are not limited to direct connection but include connection through other circuit elements where such connection is recognized as being equivalent by those skilled in the art.

DETAILED DESCRIPTION

The apparatus 10 of the present invention is shown in its operable position in FIG. 2 mounted between a first elongated metal pipe 12 and a second elongated metal pipe 14. The second pipe 14 is made of a chemically different metal than that of the first pipe 12, which means the chemical compositions of the pipes are sufficiently different to create an electrical potential between them. An example is one pipe of a copper alloy and the other of steel.

The apparatus 10 consists of a tubular support member 16 having an internal diameter similar, and preferably identical, to the pipes 12 and 14 between which it is mounted. The support member 16 attaches to each of the pipes 12 and 14 in the manner which is conventional for pipes to attach to one another, such as by bolts extending through holes in the circumferential flanges 18 and 20 at opposite ends of the support member 16 and through similar flanges 19 and 21 on pipes 12 and 14, respectively.

A first electrode 22 and a second electrode 24 are mounted to the interiors cylindrical wall 26 of the support member 16. Wires 42 and 44 electrically connect the electrodes 22 and 24, respectively, to the current source 46 to impose a current between the electrodes and create the ohmic potential drop which substantially equals the difference of the potentials of the dissimilar metals. Circumferential grooves, into which the electrodes 22 and 24 are mounted, are formed in the interior wall 26 and spaced longitudinally, which in FIG. 2 is left to right. "Longitudinal" has the usual definition of lengthwise of an elongated body.

The electrode 24 is shown enlarged in FIG. 3. The wire 44 electrically connects the current source 46 to the electrode 24 through a channel 33 formed in the support member 16. The electrode 24 is electrically insulated from the support member 16 by an electrically insulating film 36, which is preferably tetrafluoroethylene. If the support member is made of an electrically insulating material, such as fiber reinforced plastic, the film is unnecessary, since such a support member is electrically insulating.

Referring again to FIG. 2, the radially inwardly facing surfaces of the electrodes 22 and 24 are preferably flush with the radially inwardly facing surface of the support member wall 26. This arrangement avoids build-up of residue on the interior of the support member 16 and avoids excessive wear of the electrodes 22 and 24 due to fluid flow through the pipes 12 and 14. The entire radially inwardly facing surfaces of the electrodes 22 and 24 are preferably exposed to, and therefore electrically connected to, the electrolyte within the fluid chamber defined by the inner walls of the pipes 12 and 14 and the support member 16.

FIG. 4 shows a protective apparatus 50 embodying the present invention, and a graph depicting potential of the pipe with respect to a reference electrode along the length of the entire segment shown (with connecting, broken lines indicating the positions on the graph corresponding with positions on the apparatus 50). The pipes 56 and 58 are dissimilar metals containing an electrolyte (seawater), and therefore the potential of the left pipe 56 is different from the potential of the right pipe 58. This difference is reflected on the graph of FIG. 4. However, rather than a potential gradient in the electrolyte which extends into both pipes as illustrated for a conventional pipe junction in FIG. 1, the potential is extended and maintained at a constant level along the entirety of both pipes. The entire gradient occurs within the protective apparatus 50. Consequently, each pipe is itself exposed only to its own potential, as if it were infinitely long. The surface of neither pipe "sees" any effect of the presence of the other pipe.

The apparatus 50 creates an artificial voltage drop in the electrolyte, eliminating, or at least decreasing, the driving force for galvanic corrosion. Therefore, although the pipes 56 and 58 are near a pipe of different potential as in the conventional configuration, they attach directly to an end of the support 51.

Therefore, the potential gradient along the support 51, which results from the electrodes causing the artificial voltage drop, illustrates how each pipe 56 and 58 "sees" a neighbor having a potential closer to its own potential than is actually the case. The artificial potential of the electrodes in the support 51 stops, or slows, the giving up and attracting of ions from one pipe to the other pipe. This occurs because the protective apparatus 50 exposes each pipe to a potential closer to its own potential than the other pipe's actual potential. Without the attraction normally occurring, ions are not transferred from the more active metal to the more noble metal (or the transfer is significantly decreased), and galvanic corrosion does not occur (or is decreased).

Figure 7:
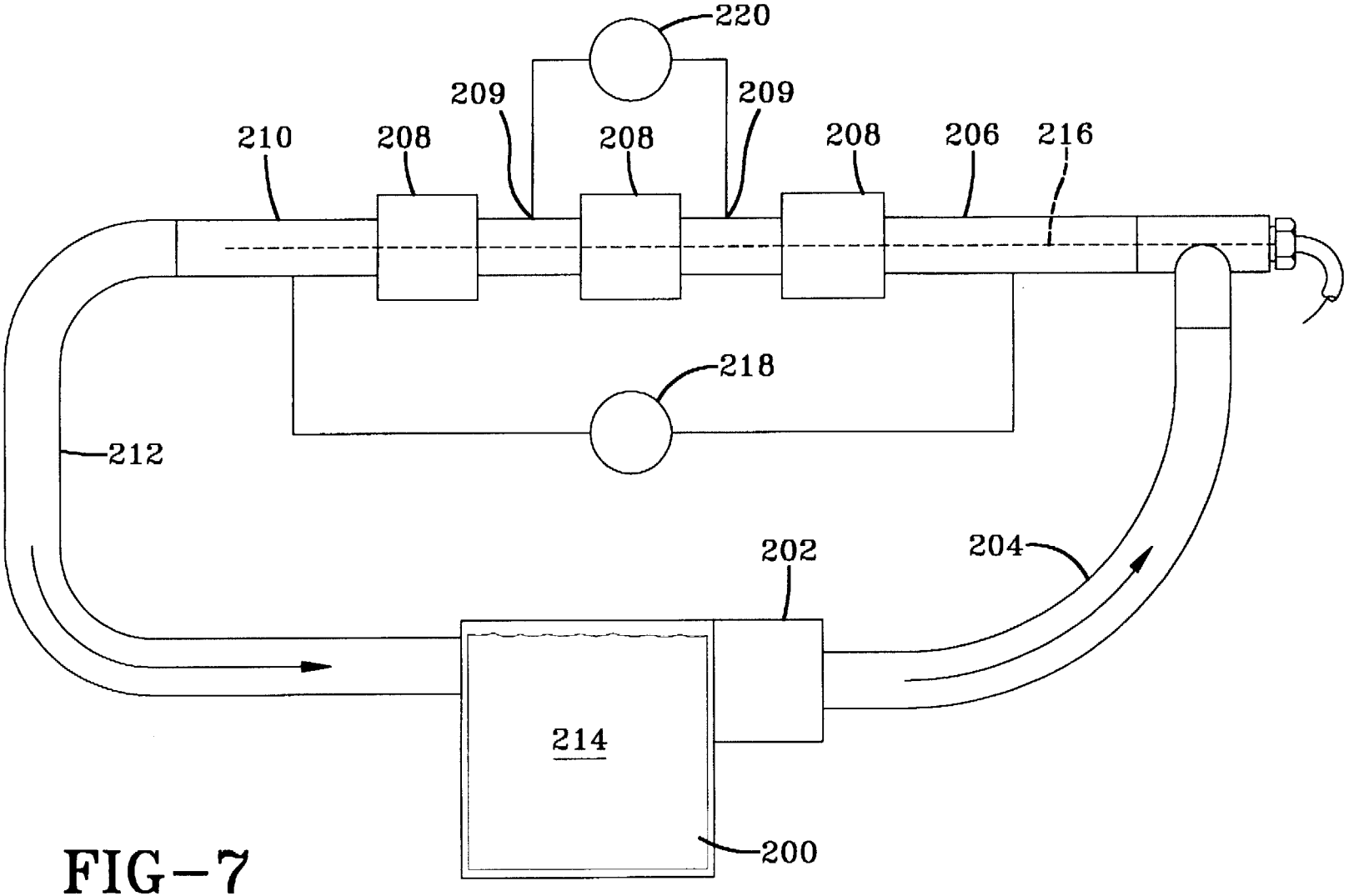
FIG. 7 is a schematic view illustrating the experimental apparatus.

An experiment was carried out using the present invention. A schematic of the experimental apparatus is shown in FIG. 7. The apparatus consists of an ASTM simulated seawater reservoir 200 to which a pump 202 is attached. A tube 204 extends from the pump 202 to a ¾ inch galvanized steel pipe 206. Three rubber hose segments 208 connect the steel pipe 206 with a pair of 2 inch long copper pipe electrodes 209, which simulate the electrodes 22 and 24 of the embodiment of FIG. 2. A piece of ¾ inch copper pipe 210 connects to the opposite side of the electrodes 209 as the steel pipe 206. The copper pipe 210 and steel pipe 206 simulate the dissimilar pipes conventionally found in ships. A tube 212 connects the copper pipe 210 with the reservoir 200. The ASTM simulated seawater 214 flowed through the apparatus at a flow rate of approximately two feet per second. The rubber hose segments 208 electrically isolated the pipes 206 and 210 from each other and from the electrodes 209.

The potential of the pipes was measured using a Luggin probe 216 connected to an external cell containing a saturated calomel reference electrode (SCE). The Luggin probe 216 consists of a 1 millimeter diameter capillary tube filled with the simulated seawater 214. The tip of the Luggin probe 216 was displaced along the length of the pipes 206 and 210 and the electrodes 209 to measure the potential throughout the apparatus for determining the potential gradient. The potential was measured at the tip of the Luggin probe 216.

Figure 8:
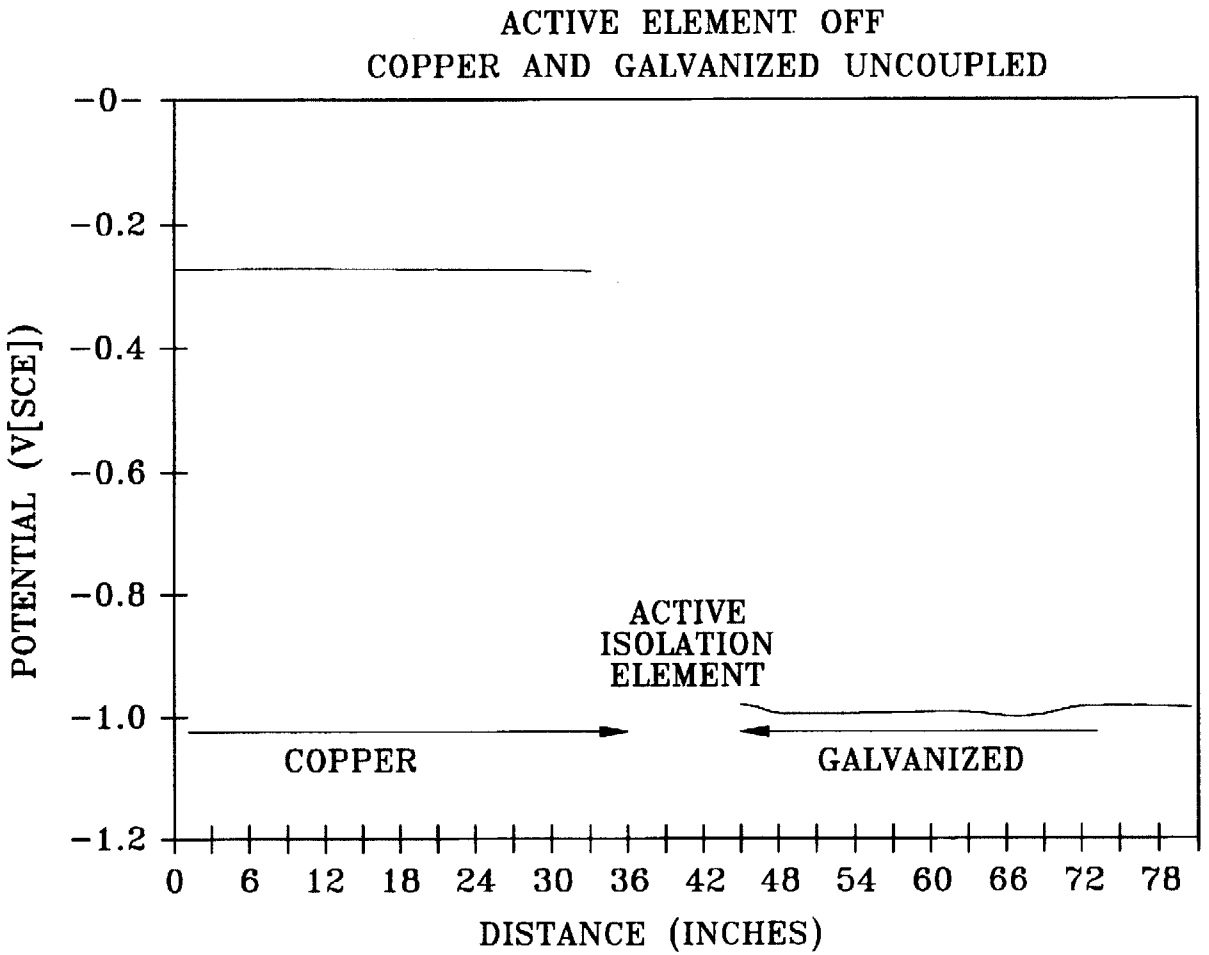
FIG. 8 is a graph of potential versus distance along the length of the experimental apparatus, with the dissimilar metals uncoupled.

Initially, the conditions of the device were measured with the seawater 214 flowing and the pipes 206 and 210 electrically insulated from one another and the electrodes 209. FIG. 8 shows the results as measured from the Luggin probe 216, showing that the potential of the copper pipe 210 was constant over its length at about −270 mV SCE and the potential of the steel pipe 206 also was approximately constant over its length and was about −1000 mV SCE.

Figure 9:
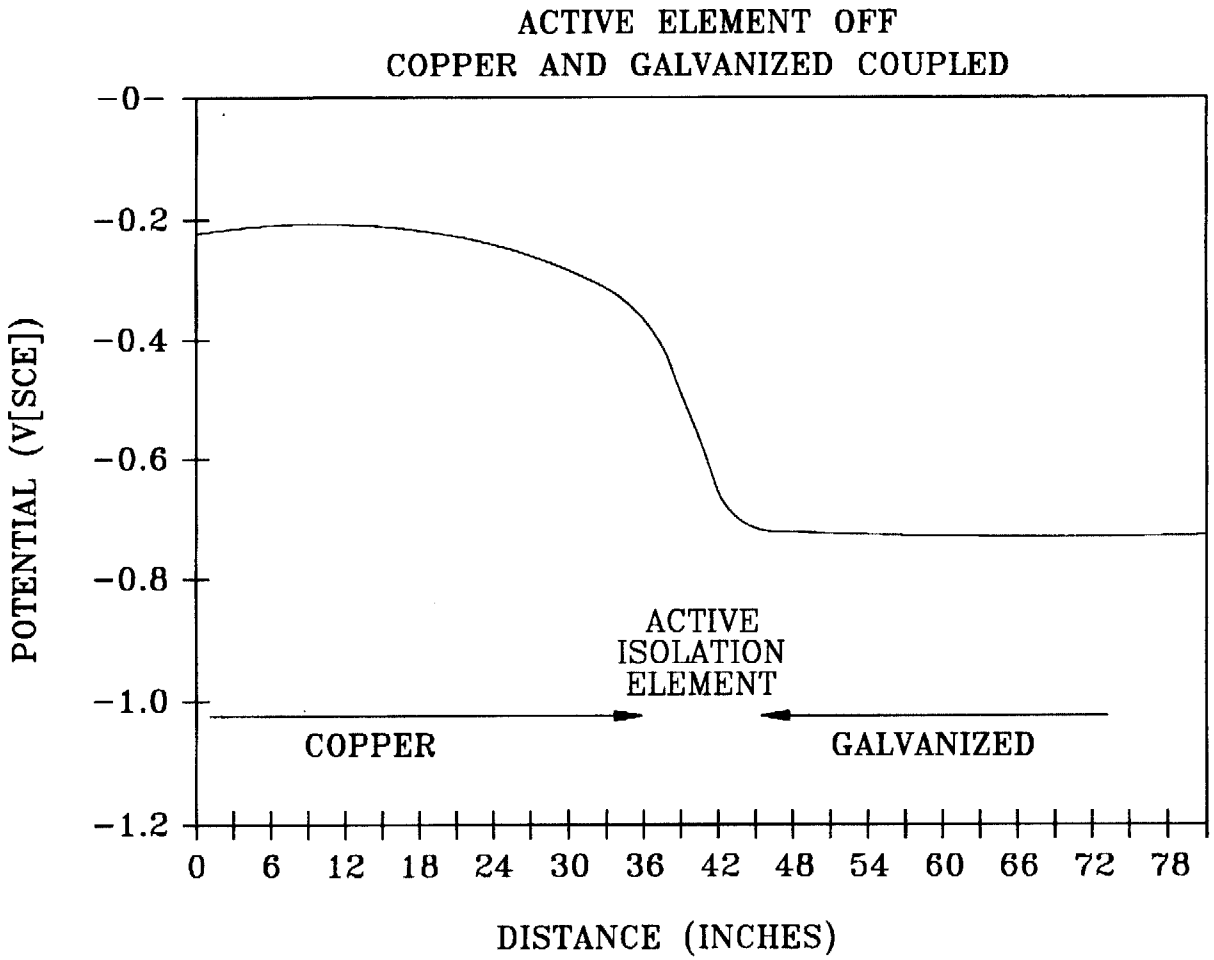
FIG. 9 is a graph of potential versus distance along the length of the experimental apparatus, with the dissimilar metals uncoupled.

The copper pipe 210 was next electrically connected to the steel pipe 206 through an external zero resistance ammeter 218. The potential was remeasured with the Luggin probe 216 and the gradient plotted in FIG. 9. FIG. 9 shows that the galvanic couple shifted the potential of the copper pipe 210 near the junction with the steel pipe 206 in the negative direction. The couple shifted the potential of the steel pipe 206 in the positive direction. These trends are typical of any galvanic couple and such trends are documented in the available literature.

Figure 10:
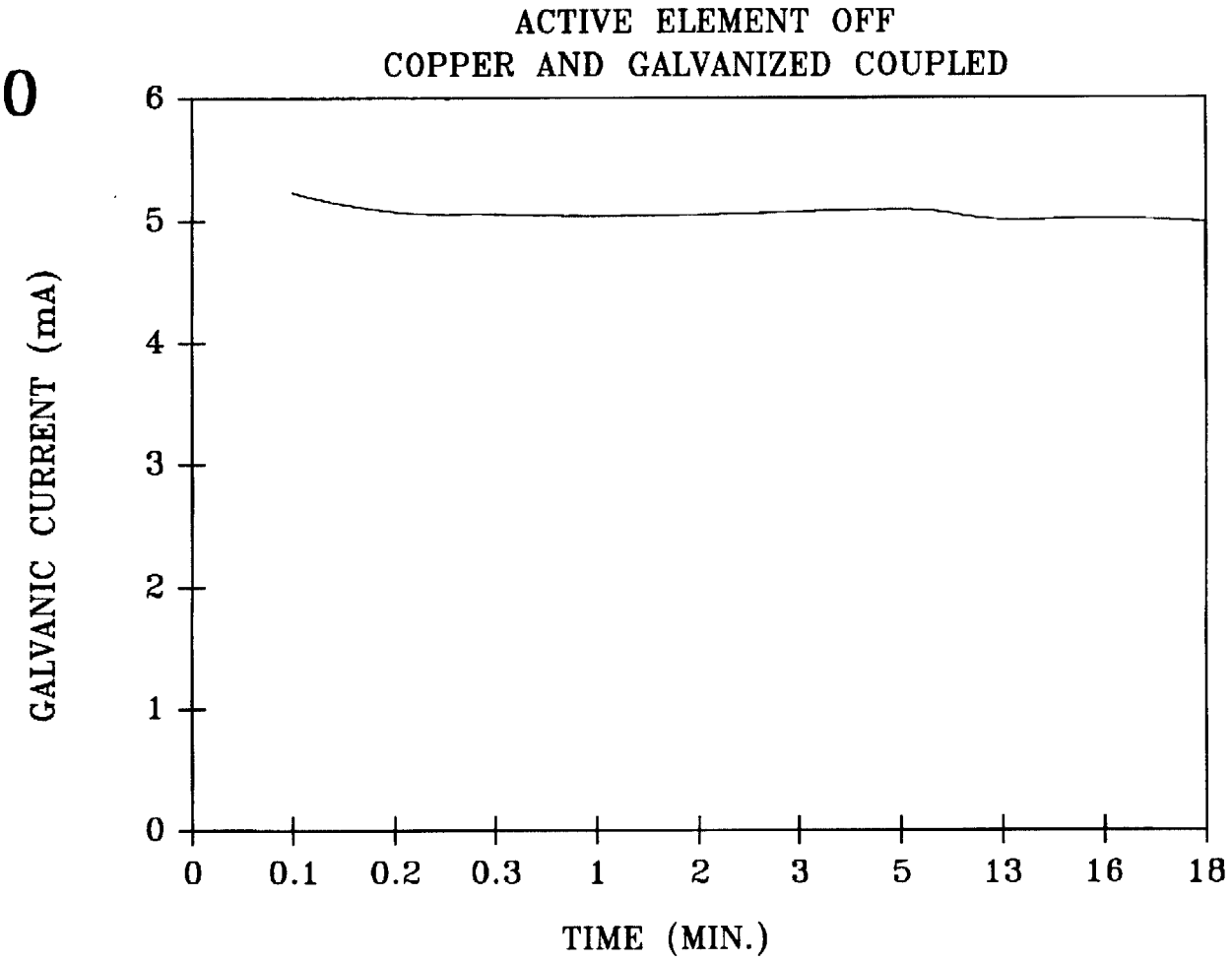
FIG. 10 is a graph of the galvanic current versus time.

The graph of FIG. 9 shows the potential gradient which is typical for a coupling of dissimilar metals, and the driving force behind the galvanic corrosion is the difference in potential. The difference in potential is what attracts ions from the steel pipe 206 to the copper pipe 210. The galvanic current flowing during the measurements shown graphically in FIG. 9 was approximately 5 mA and the direction of the current was consistent with accelerated corrosion of the galvanized steel, as expected. Additionally, the current was also essentially constant with time over several minutes as shown in FIG. 10.

Figure 11:
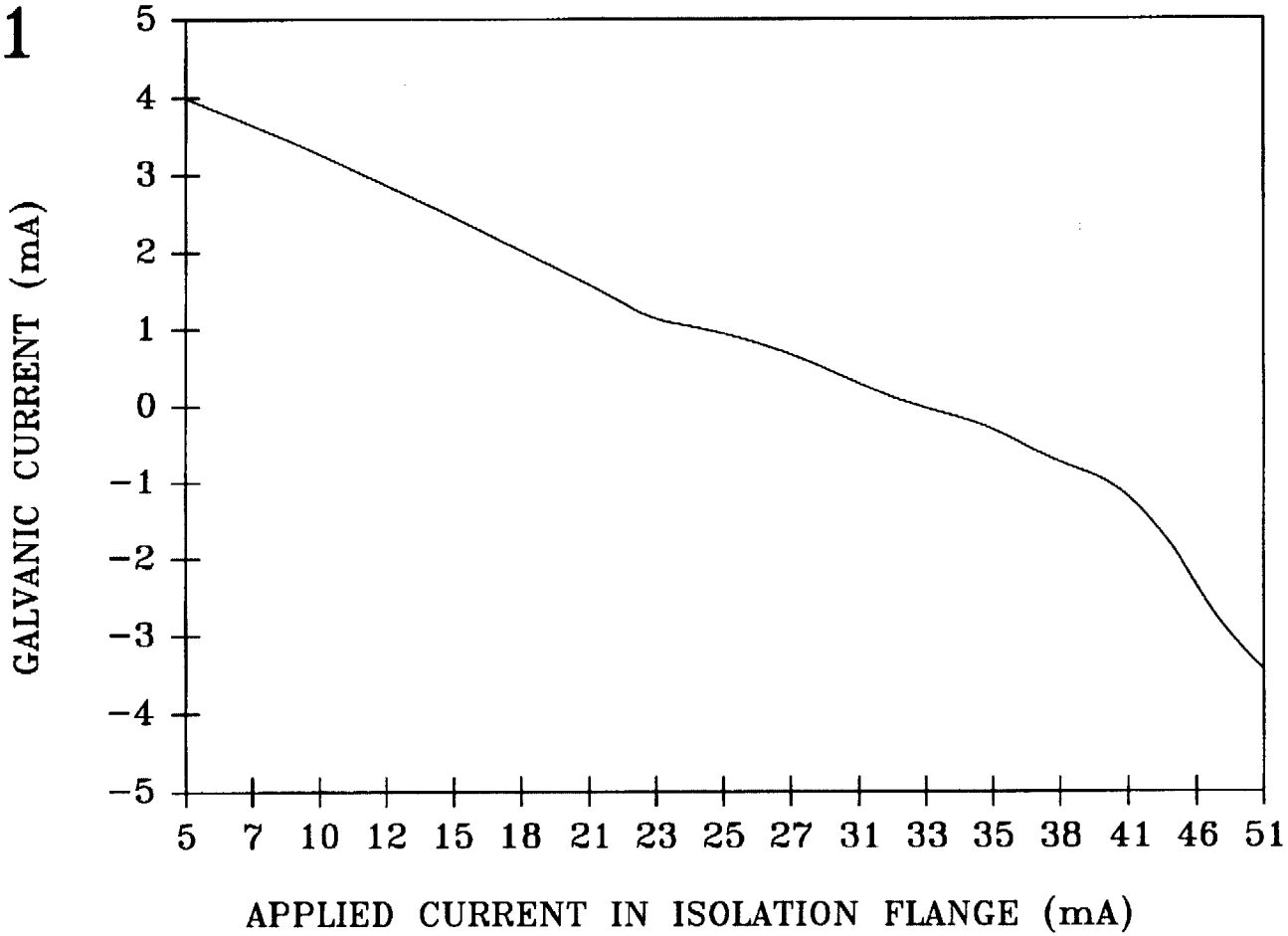
FIG. 11 is a graph of the galvanic current versus the current applied to the electrodes of the experimental apparatus.

Next, a current was applied between the electrodes 209 by the galvanostat 220. All of the applied current flow occurred between the electrodes 209, since they were insulated from the pipes 206 and 210. The galvanic current flowing between the steel pipe 206 and the copper pipe 210, was then measured as a function of the magnitude of the current applied by the galvanostat 220 between the two electrodes 209. FIG. 11 shows that approximately 30 mA of current was applied by the galvanostat 220 to reduce the galvanic current measured by the zero resistance ammeter 218 to zero. Currents applied to the electrodes 209 higher than about 30 mA caused a reverse galvanic effect where the copper pipe 210 was galvanically corroded.

Figure 12:
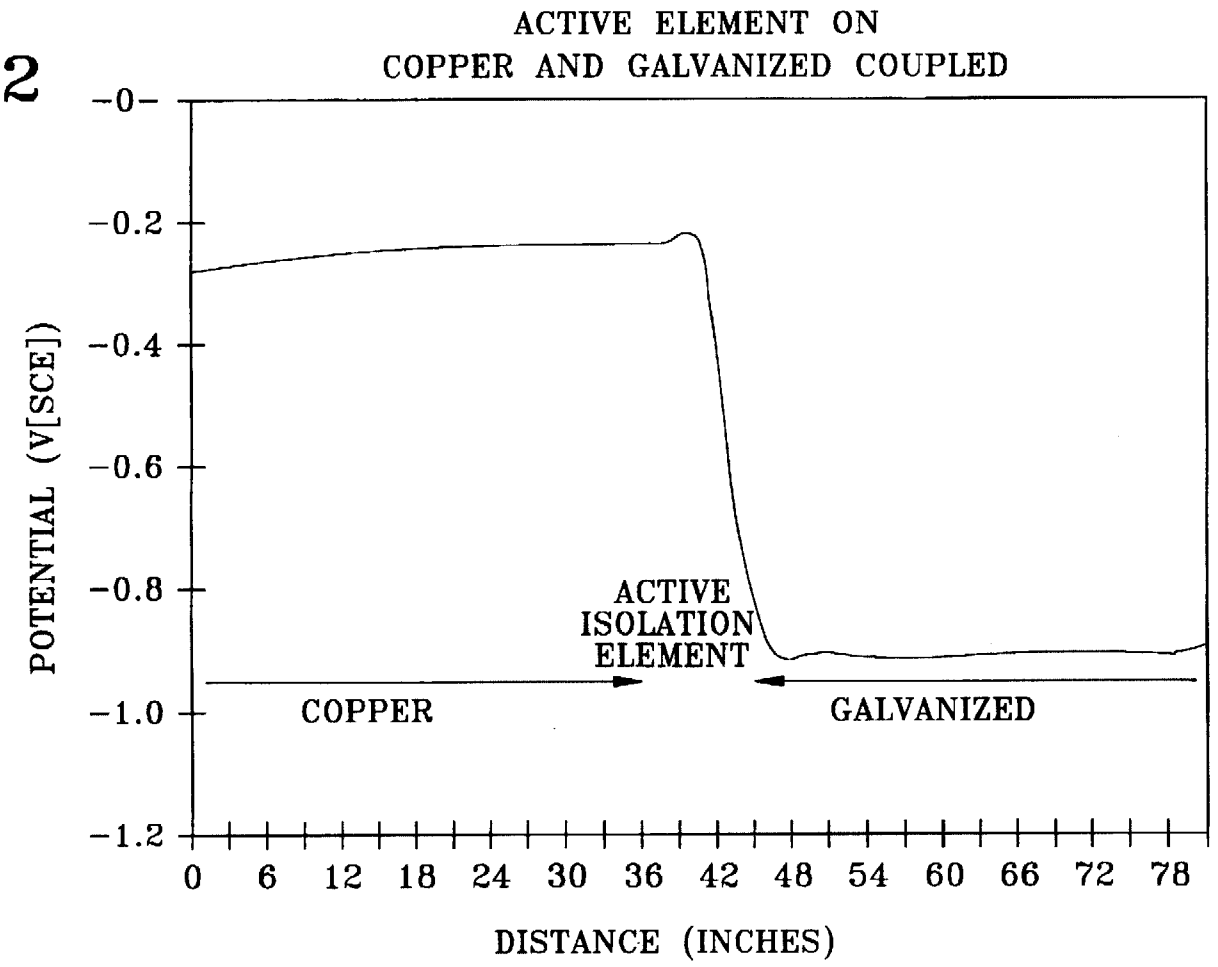

When the current applied to the electrodes 209 was 30 mA, the potential within the apparatus was remeasured using the Luggin probe 216 for determining the potential gradient. FIG. 12 shows that the curve obtained is similar to that measured when the copper pipe 210 and the steel pipe 206 were uncoupled and the potential gradient between the copper pipe 210 and steel pipe 206 was isolated to the region between the electrodes 209.

In maintaining a current between the electrodes of the invention shown in FIG. 2, it is possible to set the source 46 at a particular current and simply keep it constant for the life of the corrosion inhibiting device. However, it is preferred that the current necessary to inhibit corrosion be monitored, since scale and build-up on the pipe walls and variations in electrolytes can affect the potential difference between the two dissimilar metal pipes. An applied current which, at the time of installation, approximately counterbalances the natural potential difference between the two dissimilar metals may over time become less effective as the potentials of the dissimilar metals change. By monitoring the potential near the dissimilar metals and adjusting the applied current between the electrodes accordingly, optimal corrosion inhibition occurs. This monitoring and adjusting is performed in the embodiment shown in FIG. 5 by a feedback loop which includes a pair of sensors 100 and 110 positioned at opposite longitudinal ends of the support member 112 outside of the space between the electrodes 114 and 116. The sensors 100 and 110 must be spaced outside of the electrodes 114 and 116 to minimize errors in sensing the pipe potentials, created by the current flow between the electrodes 114 and 116. It is the potential in the pipes which must be measured, not the potential at the electrodes.

The sensors 100 and 110 are mounted in the interior cylindrical side wall 118 of the support member 112, and are connected to an electronic processor 120 which is also connected to the current source 122. The combination of the processor 120, the sensors 100 and 110, the current source 122 and the electrodes 114 and 116 is the feedback loop which varies the current applied at the electrodes 114 and 116 according to the potential sensed at the sensors 100 and 110.

As the electrodes become covered with corrosion products, the potential applied to the electrodes must maintain the potential in the electrolyte at the desired potential to inhibit corrosion of the pipes. The current source produces a constant current through the electrolyte between the electrodes regardless of changes in the impedance of the corrosion products on the electrodes, and the consequent IR drop across the layer of corrosion products. This constant current maintains the desired potential in the electrolyte for electrolyte of relatively constant impedance. If the impedance changes, the sensor system changes the current to make the potential in the electrolyte match the potential in the pipes, to the extent the electrolyte potential matched the pipes prior to the change in electrolyte impedance.

The preferred apparatus adjusts the current flow between the electrodes 114 and 116 to minimize polarization of the closest pipe from its respective free corrosion value. However, it may be preferred to apply a lower current to merely decrease the rate of corrosion. This may be done for the saving of energy.

As a further alternative, rather than using the preferred inert electrodes with an applied driving voltage, it may be desirable in some situations, such as where electrical power is not available, to use two electrodes made of dissimilar metals. The location and surface area of the electrodes is adjusted to obtain the desired direction and magnitude of current flow. This configuration is less desirable, however, because one of the electrodes (the anode) will be consumed in the process of generating the desired current.

The preferred material for use as the electrode outer surface is a platinum-based metal. Examples of these materials include platinized niobium and platinized titanium. However, virtually any electrically conducting inert anode material can be used.

The preferred material of which the support is made is an electrically insulating material such as fiber reinforced plastic. Of course, the support can be made of other materials, including metallic materials, such as titanium. If the support must bear substantial forces, it is preferably made from titanium, and this requires insulation between the support and the electrodes.

Figure 6:
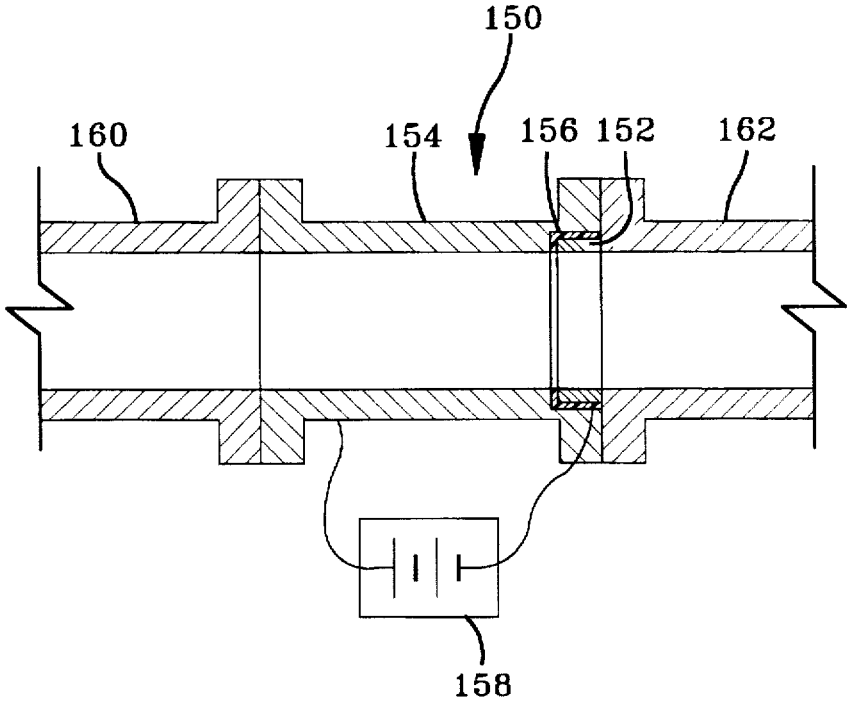
FIG. 6 is a view in section illustrating an alternative embodiment of the present invention.

A further alternative to the preferred embodiment is the apparatus 150 shown in FIG. 6. A first electrode 152 is mounted within the support 154 at one longitudinal end of the support 154. The second electrode is the interior wall of the support 154. Insulation 156 electrically separates the electrode comprising the interior wall of the support 154 from the electrode 152. A current source 158 is electrically connected to the electrode 152 and the support 154.

The embodiment of FIG. 6 functions similarly to the preferred embodiment, but with disadvantages arising from the use of the support 154 as an electrode. For example, any portion of the support 154 exposed rightwardly of the electrode 152 will reduce the effectiveness of the device by causing part of the current to flow in a direction opposite of that desired. Additionally, it is necessary to insulate between the support 154 and adjoining pipes 160 and 162, as well as between the electrode 152 and the adjoining pipe 162.

The present invention can be used with a tank, but, in general, for the invention to be effective the length to diameter ratio should be about one or higher.

While certain preferred embodiments of the present invention have been disclosed in detail, it is to be understood that various modifications may be adopted without departing from the spirit of the invention or scope of the following claims.

I claim:

1. A corrosion inhibiting apparatus mounted at the junction of two chemically different, elongated metal bodies defining an interior fluid chamber containing an electrolyte, the apparatus comprising:

(a) a support member mounted between the two metal bodies, in a gap formed between the metal bodies, spacing the metal bodies from each other;

(b) first and second longitudinally spaced electrodes mounted to the support member in communication with the electrolyte, and electrically insulated from the metal bodies; and (c) a current source having a positive terminal electrically connected to the first electrode and a negative terminal electrically connected to the second electrode.

2. An apparatus in accordance with claim 1, wherein the support member is hollow and has an interior wall.

3. An apparatus in accordance with claim 2, wherein the electrodes are mounted to the interior wall of the support member.

4. An apparatus in accordance with claim 3, wherein the first and second electrodes further comprise first and second annular metal rings.

5. An apparatus in accordance with claim 4, wherein first and second longitudinally spaced, circumferential grooves are formed in the interior wall of the support member, the first ring is mounted in the first groove and the second ring is mounted in the second groove.

6. An apparatus in accordance with claim 5, wherein a radially inwardly facing surface of each ring is flush with a radially inwardly facing surface of the support member wall.

7. An apparatus in accordance with claim 1, further comprising:

(a) a first sensor mounted to the support member and positioned near one longitudinal end of the support member outside a gap between the electrodes;

(b) a second sensor mounted to the support member and positioned near the opposite longitudinal end of the support member outside the gap between the electrodes; and (c) a feedback circuit connected to the sensors and the current source for sensing the potentials at the sensors and correspondingly adjusting the current source.

8. An apparatus in accordance with claim 1, wherein the electrodes have an inert metal-based surface.

9. An apparatus in accordance with claim 8, wherein the inert metal is platinum.

10. A corrosion inhibiting apparatus for mounting at the junction of two chemically different, elongated, metal bodies defining an interior fluid chamber containing an electrolyte, the apparatus comprising:

(a) a support member configured for mounting between the two metal bodies, in a gap formed between the metal bodies, spacing the metal bodies from each other;

(b) first and second longitudinally spaced electrodes mounted to the support member and electrically insulated from the metal bodies for communicating with the electrolyte; and (c) a current source having a positive terminal electrically connected to the first electrode and a negative terminal electrically connected to the second electrode.

11. An apparatus in accordance with claim 10, wherein the support member is hollow and has an interior wall.

12. An apparatus in accordance with claim 11, wherein the electrodes are mounted to an interior wall of the support member.

13. An apparatus in accordance with claim 12, wherein the first and second electrodes further comprise first and second annular metal rings.

14. An apparatus in accordance with claim 13, wherein first and second longitudinally spaced, circumferential grooves are formed in the interior wall of the support member, the first ring is mounted in the first groove and the second ring is mounted in the second groove.

15. An apparatus in accordance with claim 14, wherein a radially inwardly facing surface of each ring is flush with a radially inwardly facing surface of the support member wall.

16. An apparatus in accordance with claim 10, further comprising:

(a) a first sensor mounted to the support member and positioned near one longitudinal end of the support member outside a gap between the electrodes;

(b) a second sensor mounted to the support member and positioned near the opposite longitudinal end of the support member outside the gap between the electrodes; and (c) a feedback circuit connected to the sensors and the current source for sensing the potentials at the sensors and correspondingly adjusting the current source.

17. An apparatus in accordance with claim 10, wherein the electrodes have an inert metal-based surface.

18. An apparatus in accordance with claim 17, wherein the inert metal is platinum.

* * * * *